US005419272A

United States Patent [19]

Backstein et al.

[11] Patent Number: 5,419,272

[45] Date of Patent: May 30, 1995

[54] EXPLOSIVE CUTTER FOR MINE MOORINGS

[75] Inventors: Günter Backstein, Meerbusch; Klaus-Jürgen Pohl, Dormagen; Annette Dodegge, Bochum, all of Germany

[73] Assignee: Rheinmetall GmbH, Ratingen, Germany

[21] Appl. No.: 117,832

[22] Filed: Sep. 8, 1993

[30] Foreign Application Priority Data

Sep. 9, 1992 [DE] Germany ..... 42 30 071.1

[51] Int. Cl.[6] ..... B63G 7/04

[52] U.S. Cl. ..... 114/221 A; 114/313; 30/DIG. 4

[58] Field of Search ..... 114/221 A, 313; 30/DIG. 4; 89/1.13, 1.14; 102/402, 403

[56] References Cited

U.S. PATENT DOCUMENTS 3,776,165 12/1973 Sabranski et al. ..... 114/221 A
4,970,957 11/1990 Backstein et al. ..... 114/221 A

FOREIGN PATENT DOCUMENTS 0145557 12/1920 United Kingdom ..... 114/221 A

*Primary Examiner*—Sherman Basinger
*Attorney, Agent, or Firm*—Spencer, Frank & Schneider

[57] ABSTRACT

An explosive cutter for severing a mooring of a moored mine includes a securing apparatus for attaching the explosive cutter to a mooring and for detaching the explosive cutter from an underwater vessel. The securing apparatus includes a mooring capturing jaw; a clamping lever having a withdrawn position in which it is clear of the capturing jaw and a clamping position in which it closes off the capturing jaw for holding the mooring captive in the capturing jaw; and a slidable shuttle having a first position and a second position. The shuttle includes an actuator for being pressed by the mooring to move the shuttle from the first position into the second position; a detent lug cooperating with the clamping lever for releasing the clamping lever to allow it to move into the clamping position when the shuttle is moved into the second position; and a locking component having a locking position in which the locking member maintains the explosive cutter locked to an underwater vessel when the shuttle is in the first position. The locking member has a releasing position in which it frees the explosive cutter from the underwater vessel when the shuttle is moved into the second position.

5 Claims, 4 Drawing Sheets

EXPLOSIVE CUTTER FOR MINE MOORINGS

BACKGROUND OF THE INVENTION

This invention relates to an explosive cutter for mine moorings and is of the type that has a housing provided with a capturing jaw for the mine mooring and an explosive charge disposed inside the housing adjoining the capturing jaw. Further, the explosive cutter has a securing device for attaching the housing to an underwater vessel as well as a clamping device for clamping the housing to the mine mooring.

Explosive cutters for mine moorings are secured to the hull of an underwater vessel and taken by the vessel to the mine mooring of a positionally identified moored mine for mechanically attaching the explosive cutter to the mooring. Thereafter, the explosive cutter is disconnected from the underwater vessel and severs the mooring by means of the explosive charge which, in particular, is an elongated hollow charge. In known explosive cutters, however, additional vector forces are required for disconnecting the underwater vessel; thus, for example, the underwater vessel, after clamping the explosive cutter to the mooring, is driven in reverse or its buoyancy is utilized for being separated from the explosive cutter.

SUMMARY OF THE INVENTION

It is an object of the invention to provide an improved explosive cutter of the above-outlined type which, by virtue of a forward travel of the underwater vessel, is positively disconnected therefrom and clamped to the mine mooring.

This object and others to become apparent as the specification progresses, are accomplished by the invention, according to which, briefly stated, the explosive cutter for severing a mooring of a moored mine includes a securing apparatus for attaching the explosive cutter to a mooring and for detaching the explosive cutter from an underwater vessel. The securing apparatus includes a mooring capturing jaw; a clamping lever having a withdrawn position in which it is clear of the capturing jaw and a clamping position in which it closes off the capturing jaw for holding the mooring captive in the capturing jaw; and a slidable shuttle having a first position and a second position. The shuttle includes an actuator for being pressed by the mooring to move the shuttle from the first position into the second position; a detent lug cooperating with the clamping lever for releasing the clamping lever to allow it to move into the clamping position when the shuttle is moved into the second position; and a locking component having a locking position in which the locking member maintains the explosive cutter locked to an underwater vessel when the shuttle is in the first position. The locking member has a releasing position in which it frees the explosive cutter from the underwater vessel when the shuttle is moved into the second position.

DESCRIPTION OF THE PREFERRED EMBODIMENT

Figure 1:
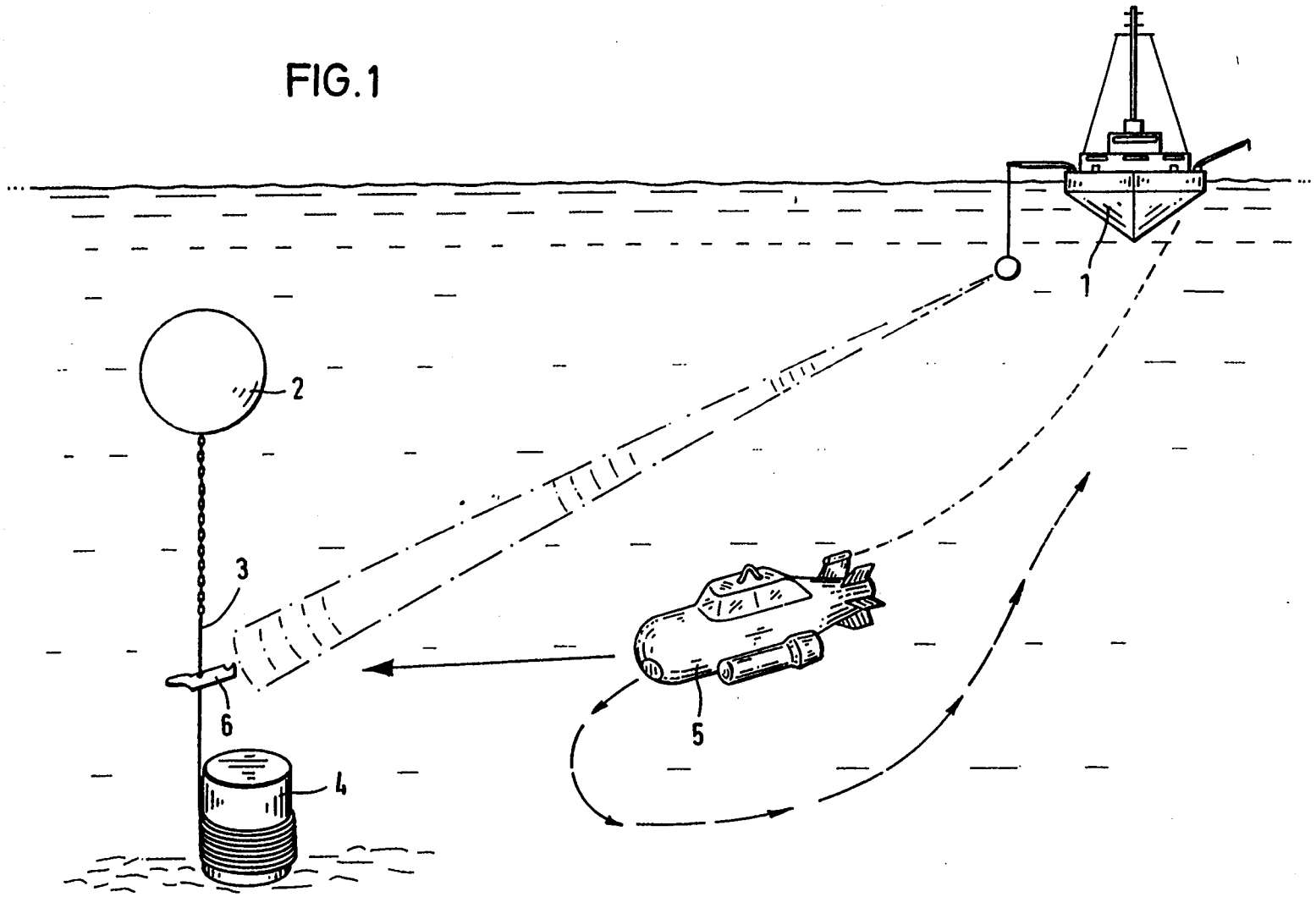
FIG. 1 is a schematic illustration of the steps of attaching an explosive cutter to a mooring of a moored mine.

Turning to FIG. 1, after a minesweeper 1 has determined the location of a moored mine 2 which is held by a mooring 3 attached to an anchor 4, an underwater vessel or craft 5 which carries at least one explosive cutter 6 is launched from the minesweeper 1 to attach one explosive cutter 6 to the mooring 3. Upon return of the underwater vessel 5 to the minesweeper 1 or after the underwater vessel 5 has reached a safe distance from the moored mine 2, the explosive cutter is detonated by coded sonar signals transmitted from the minesweeper 1. As a result, the mooring 3 is severed and the moored mine 2 surfaces, and may then be destroyed by the minesweeper 1.

Figure 2:
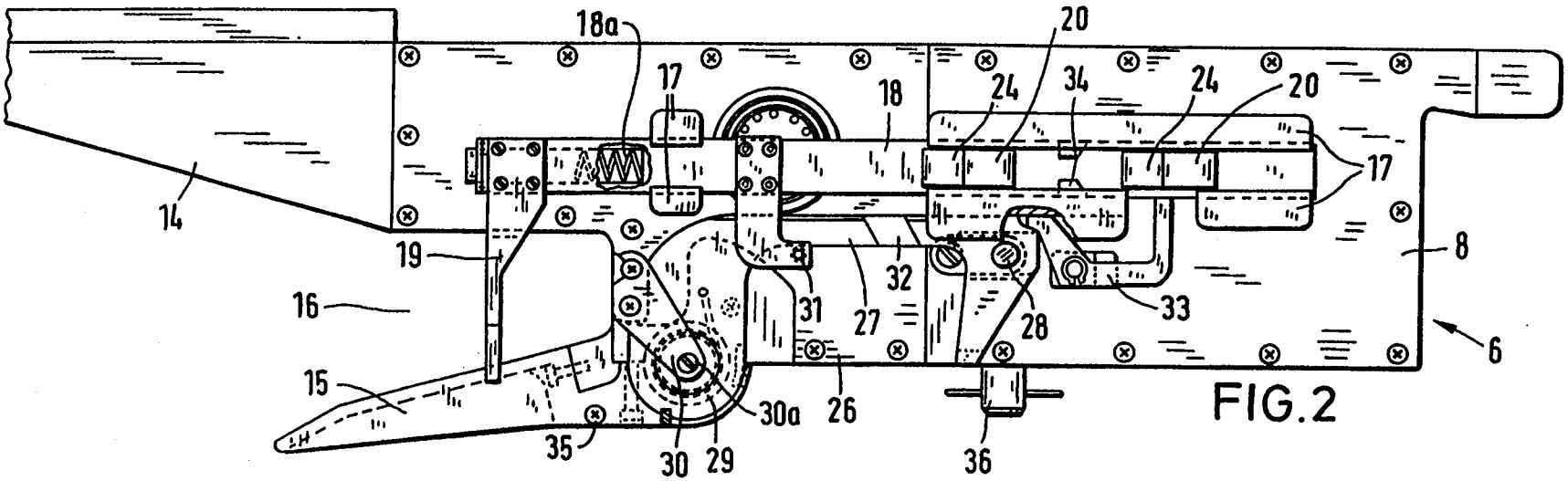
FIG. 2 is a top plan view of a preferred embodiment of the invention.
Figure 3:
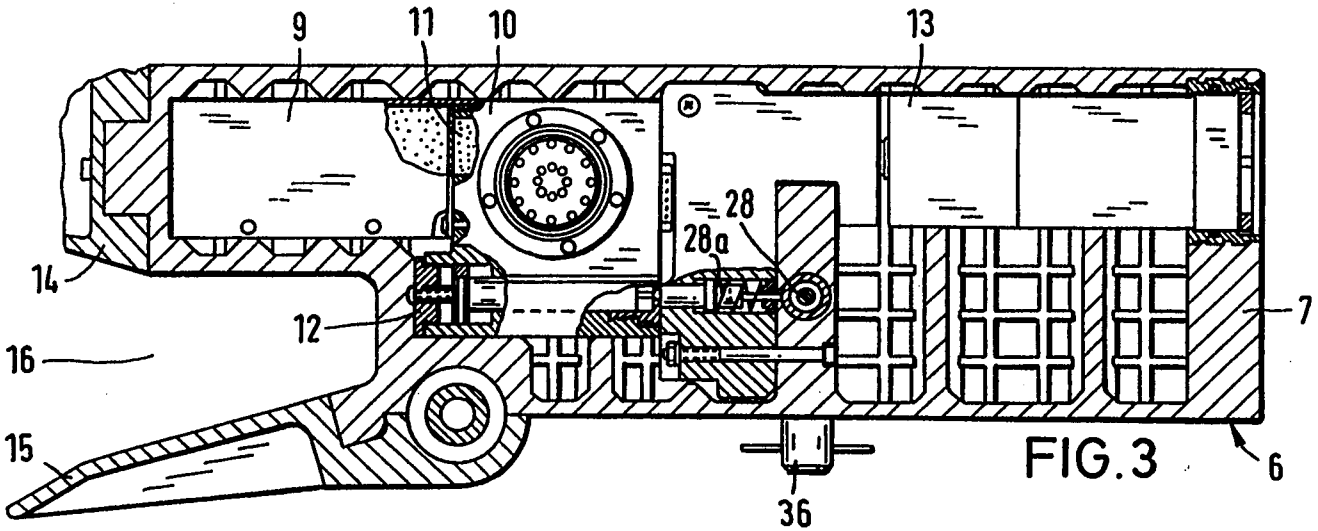
FIG. 3 is a sectional plan view of the construction shown in FIG. 2.
Figure 4:
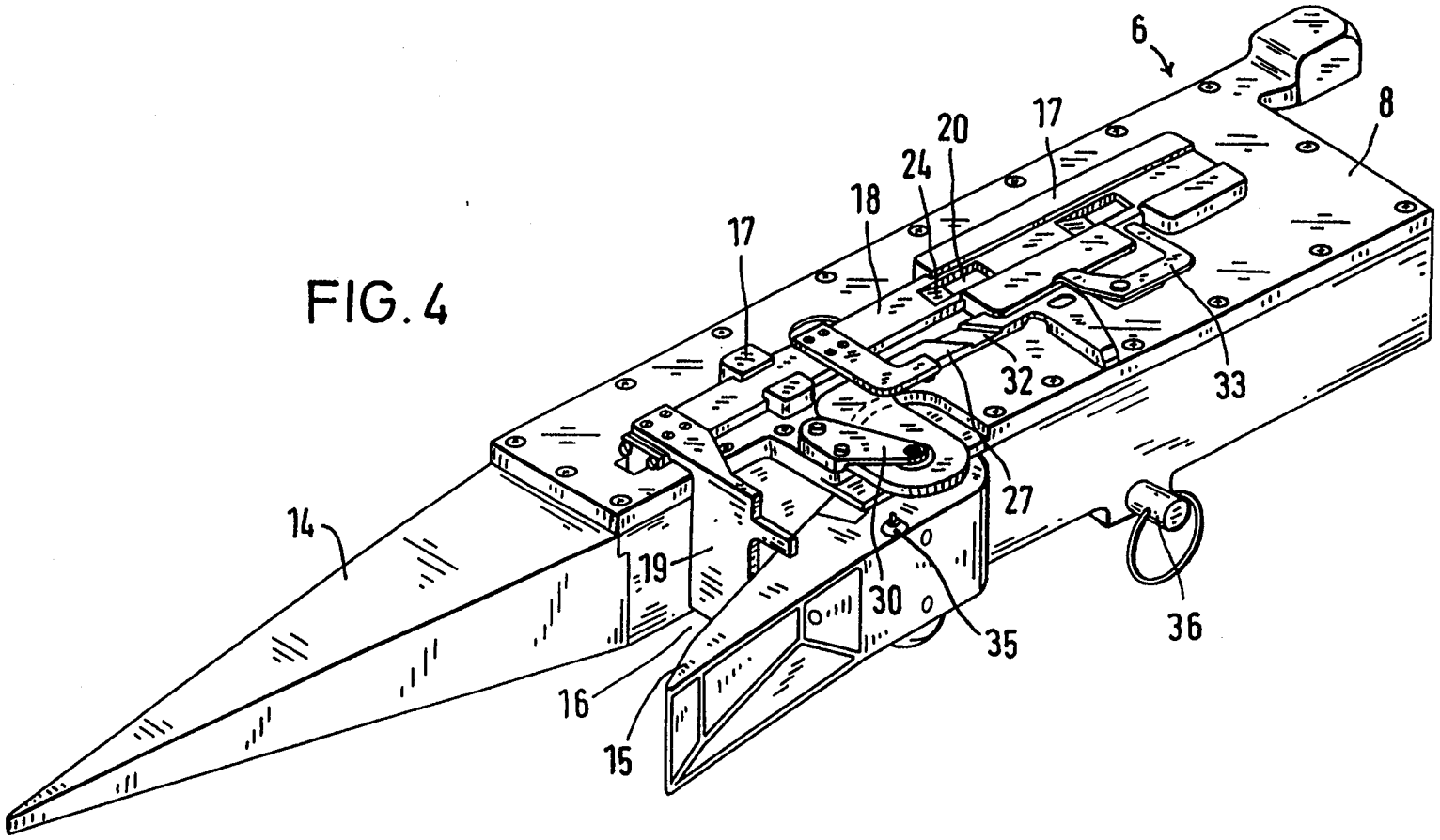
FIG. 4 is a perspective view of the preferred embodiment.

Turning to FIGS. 2, 3 and 4, the explosive cutter 6 has a housing 7 provided with a multipart lid 8. The housing 7 and lid 8 are designed such that the explosive cutter 6, together with the components disposed therein, such as an explosive cutting charge 9, a primer 10, a transfer charge 11, a pyrotechnical charge 12 and a triggering electronic circuitry 13 has an essentially neutral buoyancy. The housing 7 and the lid 8 may be made of a lightweight synthetic material such as a hard polyurethane foam. The housing 7 and the lid 8 are bonded to one another by a permanent adhesive. Further, the housing 7 is small and has a hydrodynamic shape.

A relatively long, wedge-shaped lead-in rail 14 and a relatively short lead-in rail 15, both carried by the housing 7, together form a capturing jaw 16 for the mooring 3. The lead-in rail 14 is a part made separately from the housing 7, while the lead-in rail 15 is a component separate from or integral with, the housing 7.

The lid 8 carries a guide 17 oriented parallel to the direction in which the mooring 3 enters the capturing jaw 16. In the guide 17 there is slidably arranged a shuttle 18 which, by means of a compression spring 18a is biased in the direction of the intake rails 15 and 16 and thus opposite the entering direction of the mooring 3 into the capturing jaw 16. The shuttle 18 has, at its end oriented toward the capturing jaw 16, a plate-like actuator 19 which straddles the capturing jaw 16.

Figure 5A:
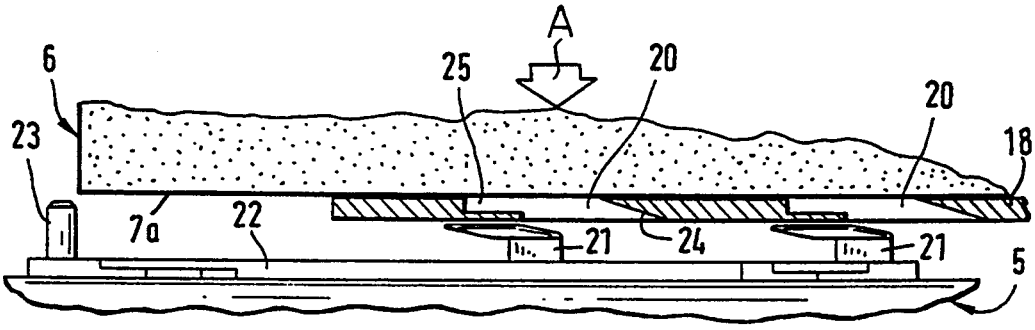
FIGS. 5*a*–5*e* are fragmentary side elevational views, partially in section, of an explosive cutter and a component carried on an underwater vessel, illustrating five successive phases in attaching the explosive cutter to and disconnecting it from the underwater vessel.

Also referring to FIG. 5*a*, the shuttle 18 has two detent notches 20 which cooperate with angled detent lugs 21 formed on an adaptor plate 22 and having an outwardly wedge-shaped configuration. The adaptor plate 22 is secured to the underwater vessel 5 and is provided with a stop 23. Each detent notch 28 is provided with an inwardly inclined ramp 24. The ramps 24 are provided at that end of each detent notch 20 which is oriented towards the lead-in rails 15, 16. At the other end, the detent notches 20 are provided with an undercut 25.

For attaching the explosive cutter 6 to the underwater vessel 5, these two components are brought together, generally in the direction of the arrow A such that the detent lugs 21 of the adaptor plate 22 adjoin the shuttle 18 externally, as shown in FIG. 5*a*. The shuttle 18 is in its normal position of rest into which it is urged by the force of the biasing spring 18*a*. In this position the detent lugs 21 cannot enter the respective detent notches 20 even if the detent lugs 21 are moved into alignment with the detent notches 20 because then the abutment pin 23 would, in cooperation with the underside 7*a* of the housing 7, prevent a necessary displacement of the explosive cutter 6 towards the underwater vessel 5.

Figure 5B:
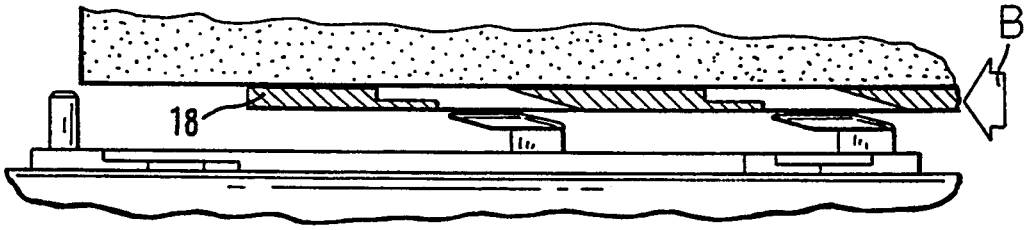
Figure 5C:
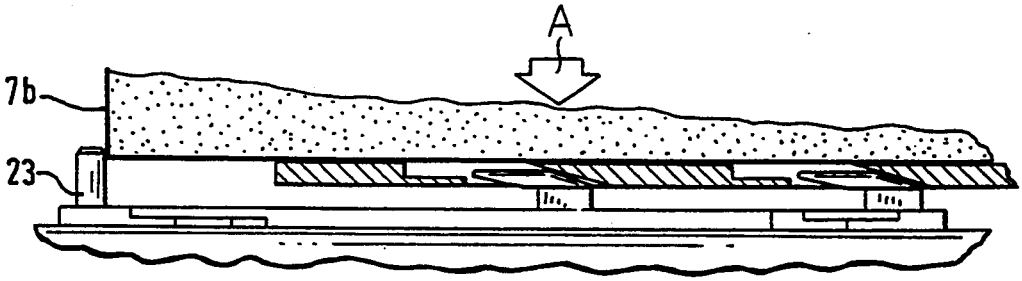
Figure 5D:
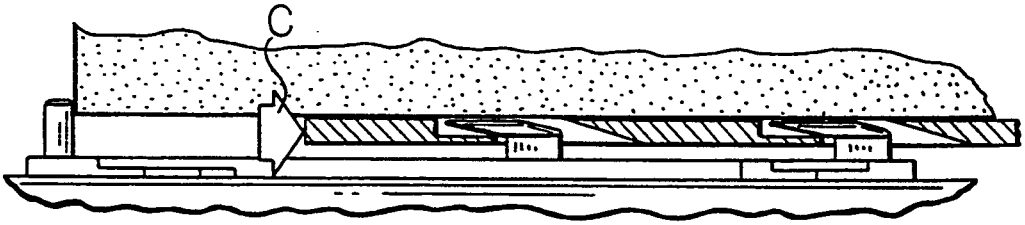

For allowing insertion of the detent lugs 21 into the respective detent notches 20, the shuttle 18 is manually displaced in the direction of the arrow B against the force of the biasing spring 18*a* to align respective detent lugs 21 with detent notches 20 as shown in FIG. 5*b*. Thereafter, the explosive cutter is moved closer to the underwater vessel 5 in the direction of the arrow A as shown in FIG. 5*c* whereupon the abutment pin 23 engages a side wall 7*b* of the housing 7 and the detent lugs 21 are received in respective detent notches 20. Then the shuttle 18 is released to allow its biasing spring 18*a* to return the shuttle 18 in the direction of arrow C into its normal position of rest as shown in FIG. 5*d*. This displacement causes the angled portions of the respective lugs 21 to enter the undercut 25 of the respective detent notches 20 while the continued abutting relationship between the abutment pin 23 and the side wall 7*b* of the housing 7 prevents a displacement of the underwater vessel 5 relative to the explosive cutter 6 in the direction of the arrow C. In this manner the explosive cutter 6 is locked to the underwater vessel 5 as illustrated in FIG. 5*d*.

It is noted that as an alternative, the detent lugs 21 may be arranged on the shuttle 18 and the detent recesses 20 may be provided on the adaptor plate 22 or on the underwater vessel 5, as the case may be.

Figure 5E:
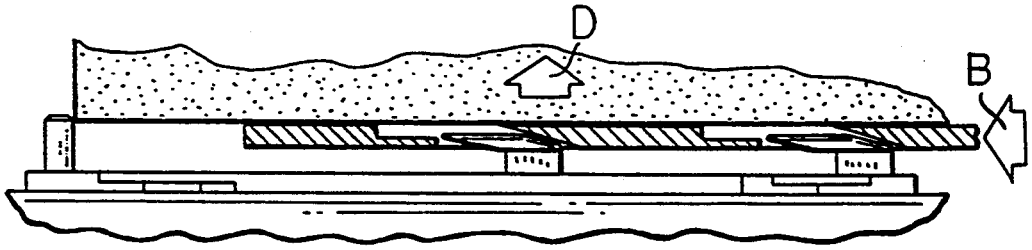

Turning to FIG. 5*e*, for disconnecting the explosive cutter 6 from the underwater vessel 5 all is needed is to shift the shuttle 18 in the direction of arrow B against the force of its biasing spring 18*a*, whereby the detent lugs 21 are pushed out of the undercuts 25 and thus leave the detent notches 20, as a result of which the explosive cutter 6 is separated from the adaptor plate 22 in the direction of arrow D. The actuation of the shuttle 18 is effected by the mooring 3 as it enters into the capturing jaw 16. Thus, the mooring 3 exerts a force on the actuator plate 19 of the shuttle 18 and moves the shuttle 18 against its biasing spring 18*a*.

The lid 8 has a recess 26 in which a bent clamping lever 27 is arranged. The clamping lever 27 is, at its free, hook-like bent end, blocked by a safety pin 28 which is disposed in the housing 7 and which is to be released prior to using the explosive cutter 6. To the other end of the clamping lever 27 a torque is applied by a spiral spring 29. The clamping lever 27 is held at the exterior of the housing 7 by means of a yoke 30 and a securing screw 30*a* which simultaneously forms the pivot pin for the clamping lever 27.

The shuttle 18 has a lug 31 which holds the clamping lever 27 in an arrested position as long as the shuttle 18 is held by the biasing spring 18*a* in its arrested position against the adaptor plate 22. When the shuttle 18 is displaced by the mooring 3 against the force of the biasing spring 18*a*, the lug 31 is, together with the shuttle 18, shifted and thus the lug 31, when it reaches the depression 32 provided in the clamping lever 27, releases the clamping lever 27 so that the latter, under the effect of the spring 29, is swung parallel to the external face of the lid 8 into a position in which it surrounds the mooring 3 and closes the otherwise open entrance of the capturing jaw 16.

To ensure that, when the explosive cutter 6 is released from the underwater vessel 5, the biasing compression spring 18*a* does not push back the shuttle 18 into its starting position, on the lid 8 a locking lever 33 is provided which is spring-biased against the shuttle 18 and which, as the shuttle 18 reaches its terminal position, drops into an aperture 34 provided laterally in the shuttle 18 to thus hold the shuttle 18 in the returned position against the spring bias. The locking lever 33 is releasable by a pivotal motion of the clamping lever 27.

At its underside the clamping lever 27 may be provided with a plurality of ratchet teeth which cooperate with a detent 35 to ensure that the clamping lever 27 is prevented from unintentionally pivoting back from its position which closes the entrance of the capturing jaw 16. The clamping lever 27 pivots through a distance until the mooring 3 is clamped between the lever 27 and the gate 19.

The pivotal motion of the clamping lever 27 simultaneously serves for actuating a switch to close a current supply circuit for an electronic triggering device 13. For this purpose, the safety pin 28 is biased against the clamping lever 27 by a spring 28*a* and is blocked by a pin 36 which may be manually removed. The safety pin 28 extends into an opening of the clamping lever 27 in its position in which it blocks the motion of the clamping lever 27. After manually removing the pin 36 the safety pin 28 is displaced, against the force of the biasing spring 28*a*, inwardly into the housing 7 by the clamping lever 27 upon its release, whereby the switch for the electronic triggering device 13 is actuated.

The release pin 36 has a circumferential groove for receiving the free end of the safety pin 28. Upon removal of the release pin 36 the safety pin 28 is moved in an axial direction so that the O-rings which are arranged for sealing purposes on the safety pin 28 are also positively displaced and no longer prevent a motion of the safety pin 28 urged by the spring 28*a*.

After releasing the explosive cutter 6 from the underwater vessel 5, the latter moves to a safe distance from the explosive cutter 6 whereupon, by transmitting coded sonar signals after a predetermined delay of, for example, 15 minutes, the pyrotechnical charge 12 is activated, and a second safety arms the primer 10 of the cutting charge 9. The first safety mechanism of the primer 10 has been released in response to a predetermined water depth of, for example, 5 m.

The mechanically moving parts of the explosive cutter 6 are mostly of aluminum.

It will be understood that the above description of the present invention is susceptible to various modifications, changes and adaptations, and the same are intended to be comprehended within the meaning and range of equivalents of the appended claims.

What is claimed is:

1. In an explosive cutter for severing a mooring of a moored mine; the explosive cutter including a securing apparatus for attaching the explosive cutter to a mooring of a moored mine and for detaching the explosive cutter from an underwater vessel carrying the explosive cutter to the mooring;

the improvement wherein said securing apparatus comprises (a) an adaptor plate for permanent securement to the underwater vessel; said adaptor plate having a first detent lug;

(b) a housing;

(c) a capturing jaw supported by the housing for receiving the mooring as the underwater vessel carries the explosive cutter to the moored mine;

(d) a clamping lever supported by the housing and having a withdrawn position in which it is clear of the capturing jaw and a clamping position in which it closes off the capturing jaw for holding the mooring captive in said capturing jaw;

(e) means for urging said clamping lever from said withdrawn position into said clamping position;

(f) a shuttle slidably supported by said housing and having a first position and a second position; said shuttle including (1) an actuator situated in said capturing jaw for being pressed by the mooring to move said shuttle from the first position into the second position;

(2) a second detent lug cooperating with said clamping lever for holding said clamping lever in said withdrawn position when said shuttle is in the first position and for releasing said clamping lever to allow said clamping lever to move from said withdrawn position into said clamping position when said shuttle is moved from said first position into said second position; and (3) means defining a detent notch for cooperating with said first detent lug of said adaptor plate; said detent notch having a locking position in which said first detent lug and said detent notch are in a locking position for maintaining said explosive cutter locked to the underwater vessel when said shuttle is in said first position; said detent notch having a releasing position in which said detent notch releases said first detent lug for freeing said explosive cutter from said underwater vessel when said shuttle is moved from said first position into said second position; and (g) a spring urging said shuttle into said first position.

2. An explosive cutter as defined in claim 1, wherein said means defining said detent notch includes a ramp bordering an end of said detent notch.

3. An explosive cutter as defined in claim 1, wherein said means defining said detent notch includes means defining an undercut situated at an end of said detent notch remote from said ramp for receiving a part of said first detent lug in said locking position.

4. The explosive cutter as defined in claim 1, further comprising a spring-biased locking lever blocking said shuttle in said second position; said locking lever and said clamping lever cooperating such that said locking lever is released by said clamping lever upon motion of said clampings lever from said withdrawn position into said clamping position.

5. The explosive cutter as defined in claim 1, wherein said clamping lever is pivotal and said means for urging said clamping lever is a spiral spring applying a torque to said clamping lever.

* * * * *